US008046967B2

(12) United States Patent
Suare et al.

(10) Patent No.: US 8,046,967 B2
(45) Date of Patent: Nov. 1, 2011

(54) TRANSLUCENT RESIN WALL SYSTEM

(75) Inventors: Ruben Suare, Salt Lake City, UT (US); R. Talley Goodson, Salt Lake City, UT (US)

(73) Assignee: 3form, Inc., Salt Lake City, UT (US)

( * ) Notice: Subject to any disclaimer, the term of this patent is extended or adjusted under 35 U.S.C. 154(b) by 1474 days.

(21) Appl. No.: 11/402,720

(22) Filed: Apr. 12, 2006

(65) Prior Publication Data

US 2006/0260234 A1 Nov. 23, 2006

Related U.S. Application Data

(60) Provisional application No. 60/671,898, filed on Apr. 15, 2005.

(51) Int. Cl.

| | |
|---|---|
| ***E04B 2/00*** | (2006.01) |
| ***E04B 5/00*** | (2006.01) |
| ***E04B 9/00*** | (2006.01) |
| ***E06B 3/26*** | (2006.01) |
| ***E06B 3/28*** | (2006.01) |
| ***E04C 2/38*** | (2006.01) |

(52) U.S. Cl. ..... 52/506.06; 52/203; 52/475.1

(58) Field of Classification Search ..... 52/202, 52/203, 171.3, 309.1, 311.1, 475.1, 506.06, 52/235, 781.3, 204.591, 204.59, 104, 80.1, 52/483.1; 403/373; 248/220.22, 316.8; 40/624
See application file for complete search history.

(56) References Cited

U.S. PATENT DOCUMENTS

| | | | | |
|---|---|---|---|---|
| 3,388,515 | A * | 6/1968 | Gruettner | 52/222 |
| 3,768,186 | A * | 10/1973 | Chase et al. | 40/624 |
| 3,785,104 | A * | 1/1974 | Dailen | 52/204.597 |
| 4,212,445 | A * | 7/1980 | Hagen | 248/245 |
| 4,500,572 | A * | 2/1985 | Francis | 428/34 |
| 4,581,868 | A * | 4/1986 | McCann | 52/204.593 |
| 4,680,206 | A * | 7/1987 | Yoxon et al. | 428/34 |
| 4,893,443 | A * | 1/1990 | Haber | 528/208 |
| 5,177,921 | A * | 1/1993 | Dempster | 52/204.591 |
| 5,540,018 | A * | 7/1996 | Biggers | 52/202 |
| 6,138,968 | A * | 10/2000 | Svantesson et al. | 248/222.13 |
| 6,502,355 | B1 * | 1/2003 | Bori | 52/202 |
| 6,978,579 | B1 * | 12/2005 | Trinca | 52/203 |
| 7,303,810 | B2 * | 12/2007 | Goodson et al. | 428/212 |
| 7,504,159 | B1 * | 3/2009 | Suare et al. | 428/532 |
| 7,555,818 | B2 * | 7/2009 | Erskine et al. | 24/305 |
| 7,607,854 | B1 * | 10/2009 | Goodson et al. | 403/73 |
| 7,691,486 | B1 * | 4/2010 | Suare et al. | 428/532 |
| 2005/0023425 | A1 * | 2/2005 | Jackson | 248/304 |

* cited by examiner

*Primary Examiner* — Eileen D Lillis
*Assistant Examiner* — Andrew Triggs
(74) *Attorney, Agent, or Firm* — Workman Nydegger

(57) ABSTRACT

A translucent wall in accordance with the present invention is configured to provide aesthetic qualities to existing walls using resin-based panels. In one implementation, one or more resin-based panels are mounted to an existing wall using one or more easily assembled frames and one or more standoffs. The panels, frames, and standoffs are configured to mount the resin-based panels away from the wall by a specific distance, thereby allowing light to be transmitted through the resin-based panels. This light transmittance in turn provides a number of decorative advantages in terms of coloring, texturing, and in terms of exhibiting decorative objects embedded in the resin-based panels. The one or more frames used in accordance with the present invention can be easily adapted to any interior or exterior space or finish, such that the disclosed systems can benefit from mass-production techniques.

10 Claims, 12 Drawing Sheets

TRANSLUCENT RESIN WALL SYSTEM

CROSS-REFERENCE TO RELATED APPLICATIONS

The present invention claims the benefit of priority to U.S. Provisional Patent Application No. 60/671,898, filed on Apr. 15, 2005, entitled "Translucent Resin Wall System," the entire contents of which are incorporated herein by reference.

BACKGROUND OF THE INVENTION

1. The Field of the Invention

This invention relates to systems and methods for creating and installing resin-based panels that can be used as decorative architectural walls.

2. Background and Relevant Art

Some recent architectural designs have implemented synthetic, polymeric resins, which can be used as windows, ceiling panels, partitions, walls, etc., in offices and homes. Present polymeric resin-based materials generally used for creating decorative resin-based panels comprise polyvinyl chloride or "PVC" materials; polyacrylate materials such as acrylic, and poly(methylmethacrylate) or "PMMA;" polyester materials such as poly(ethylene terephthalate), or "PET;" poly(ethylene terephthalate modified with a compatible glycol such as 1,4-dimethanol or 2,2-dimethyl-1,3-propanediol) or "PETG" (or "PCTG"); as well as polycarbonate materials.

In general, resin-based materials such as these are now popular compared with decorative cast glass or laminated glass materials, since resin-based materials can be manufactured to be more resilient, and to have a similar transparent, translucent, or colored appearance as cast or laminated glass, but with less cost. Decorative resin-based panels can also provide more flexibility, compared with glass, in terms of color, ability to texture, gauge availability, lower material density (implying lower panel weight) and considerably higher impact resistance. Furthermore, decorative resin-based panels have a fairly wide utility since they can be manufactured and fabricated to include a wide variety of artistic colors and images. This stated flexibility applies both in the manufacturing phase, as well as in the post-manufacturing, or ultimate-use, phase.

One use-based application of polymeric resins in architectural environments is that of a decorative panel, which can be used to decorate an existing wall, an interior wall or ceiling finish, or as a new wall partition. For example, a 4×8 foot resin-based panel could be used as a partition wall by inserting the resin-based panel inside a wood, plastic or metal frame that has bottom, side, and top grooves for holding the resin-based panel securely. If the resin-based panel is translucent, the resin-based panel might also be formed with embedded decorative materials, which could provide additional creative features to the partition or interior finish. Light transmitted on either side of the wall will provide an aesthetic effect to viewers on the opposing side.

In other cases, such as with existing, non-partition walls, a colored, resin-based panel can also be mounted directly against the existing wall (e.g., existing drywall) to provide another kind of aesthetic effect. This is ordinarily done using a combination of adhesives and/or other mounting materials such as two-sided tapes, screws, glues and the like. Unfortunately, the aesthetic effect of this type of resin-based panel material is limited since the resin-based panel's opacity is important for obscuring the mounting materials (e.g., adhesives, existing dry wall, and so forth). In particular, resin walls used in this type of environment will not ordinarily include decorative objects, and are not constructed to allow light to transmit through the resin-based panel as such translucency can often exhibit a shadowing effect, which is considered undesirable by designers and architects.

There are yet additional challenges for mounting these types of resin-based panels directly to an existing wall. For example, the resin-based panels can be fairly heavy relative to the adhesives, and the materials and methods for mounting these materials are often not readily configured for the type of expansion and/or contraction that can effect the resin-based panels over time. Furthermore, existing wall treatment systems designed for polymeric materials also suffer from issues associated with the "creep" of resin-based material over time. Creep occurs when the resin-based material flows over time in the direction of gravity, such that some resin-based panels can gain a slight degree visual distortion in a portion of the panel. Furthermore, creep, in addition to any expansion and contraction of material due to temperature changes, can cause the polymeric-based or resin-based panels to buckle and/or deflect where held in a rigid fashion. For this reason, polymeric materials used in wall panel systems have traditionally been limited to materials that may be more dimensionally stable such as glass, woods, concrete, gypsum, metals and the like, but nevertheless less aesthetically desirable materials due to their lack of translucency.

There are other ways in which decorative walls can be fastened to an existing wall to create decorative effects, which can avoid some of the disadvantages of using primarily opaque materials. For example, some builders will mount a translucent glass panel to an existing wall using one or more "standoffs" that are designed to mount into a specifically designed frame for the existing wall, or, in other configurations, to mount directly to metal or wood studs in the wall, or some other concrete or steel substrate. This type of mounting allows light to pass from the gap—created by the standoffs—between the frame that was mounted to the existing wall and the translucent glass panel, and to the other side of the panel to thereby create an aesthetic effect.

Unfortunately, glass is a heavier, often more expensive, and typically more fragile material than polymeric resin-based panels. In particular, the weight of glass makes it fairly difficult, if not impossible, to mount a glass panel to common drywall or wood wall substrates. Furthermore, the frame systems used to mount the glass panels in a standoff position from an existing wall tend to be quite complicated, tend to need precise measurements of the existing wall, and also tend to involve a significant amount of labor to install. Still further, glass panels cannot be easily modified to incorporate decorative materials, and so are limited in the type of aesthetic effect they can provide, even after taking the time to create and install them in a specific environment. Yet still further, glass systems that use standoffs attached directly to the wall must be pre-fabricated to accommodate the natural expansion and contraction that could otherwise be field-fabricated with resin-based panels.

Another of the problems with existing panel systems is that many attachment points are typically needed in order to counter the tendency of the attached material to deflect under its own weight. This is partially because systems generally rely on supporting the panel from the bottom portion of the panel. In addition, existing panel or wall systems are configured to hold the given panels in their existing shape, which tend to be either flat or curved, with little additional variation thereof. Unfortunately, to achieve a curved wall surface, the wall system frame (or relevant attachment objects) will ordinarily need to be constructed to match the curves of the material, which can result in significant expense, complexity, and still other aesthetic limitations.

BRIEF SUMMARY OF THE INVENTION

The present invention solves one or more problems in the art with systems, methods, and apparatus configured to provide existing walls with decorative, translucent resin-based panels in a simple, cost-effective, and aesthetically pleasing manner. In particular, systems and methods in accordance with implementations of the present invention relate to mounting polymeric resin-based panels, which can be modified to provide a wide range of aesthetic effects, such as having a light source shine through from behind the resin-based walls compared to an existing wall constructed with other materials.

For example, a translucent wall assembly in accordance with at least one implementation of the present invention includes a frame having one or more vertical members and one or more horizontal members. The frame is configured to be vertically positioned adjacent an existing wall. The frame also has one or more standoffs connected thereto, which are ultimately used to fasten one or more polymeric resin-based panels to the frame in an at least adjacent fashion. The translucent wall assembly also includes a polymeric resin-based panel connected to the frame via at least a portion of one or more standoffs. The distance provided by the standoffs relative to the frame allows light to pass from a front side that opposes the frame to a back side that faces the frame, and from the back side that faces the frame to the front side that opposes the frame.

Alternately, a frame assembly for mounting one or more resin-based panels to an existing wall at an extended position includes, for example, a plurality of horizontal members having a groove formed therein, as well as a plurality of vertical members also having a groove formed therein. The frame assembly further includes a plurality of standoffs slidingly-coupled to the groove of one of the plurality of horizontal members or to the groove of one of the plurality of vertical members. The plurality of standoffs are also coupled on an opposing end to either one or more resin-based panels, or to a secondary frame to which the one or more resin-based panels are mounted.

Accordingly, implementations of the present invention provide a number of advantages to builders and/or architects looking to enhance existing walls, such that the existing walls can take on the aesthetic properties of the resin-based panels, including incorporating lighting from behind. These aesthetic properties can be many and varied, and can include variations in color, texture, inclusion of different types of decorative objects, as well as differing shapes. Furthermore, wall and/or frame systems in accordance with the present invention can be readily adjusted in the relevant attachment positions over time to account for any potential creep and/or expansion/contraction of the given polymeric panels. Still further, the panels and systems described herein can also be made to include fire resistance properties, such as may be needed in certain types of manufacturing or building environments as sometimes required by building officials or local building codes.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to provide existing walls with decorative, translucent resin-based panels in a simple, cost-effective, and aesthetically pleasing manner. In particular, systems and methods in accordance with implementations of the present invention relate to mounting polymeric resin-based panels, which can be modified to provide a wide range of aesthetic effects, such as having a light source shine through from behind the resin-based walls compared to an existing wall constructed with other materials.

In particular, and as will be understood more fully from the following specification and claims, one aspect of the invention includes positioning one or more translucent resin walls at a standoff position from an existing wall. Another aspect of the invention includes providing an existing walls with resin-based panels that have been enhanced in one or more ways for color, degree of translucence, fire-resistance, and/or to include one or more decorative objects. Still another aspect of the present systems includes mounting the one or more resin-based panels to an existing wall using any number of techniques in order to provide a wide variety of formational effects such as straight, grid-like, or curved effects. A further aspect of the invention includes providing ease of installation, as well as greater durability of the resin wall by accounting for material creep, and/or allowing for natural expansion and contraction.

Figure 1A:
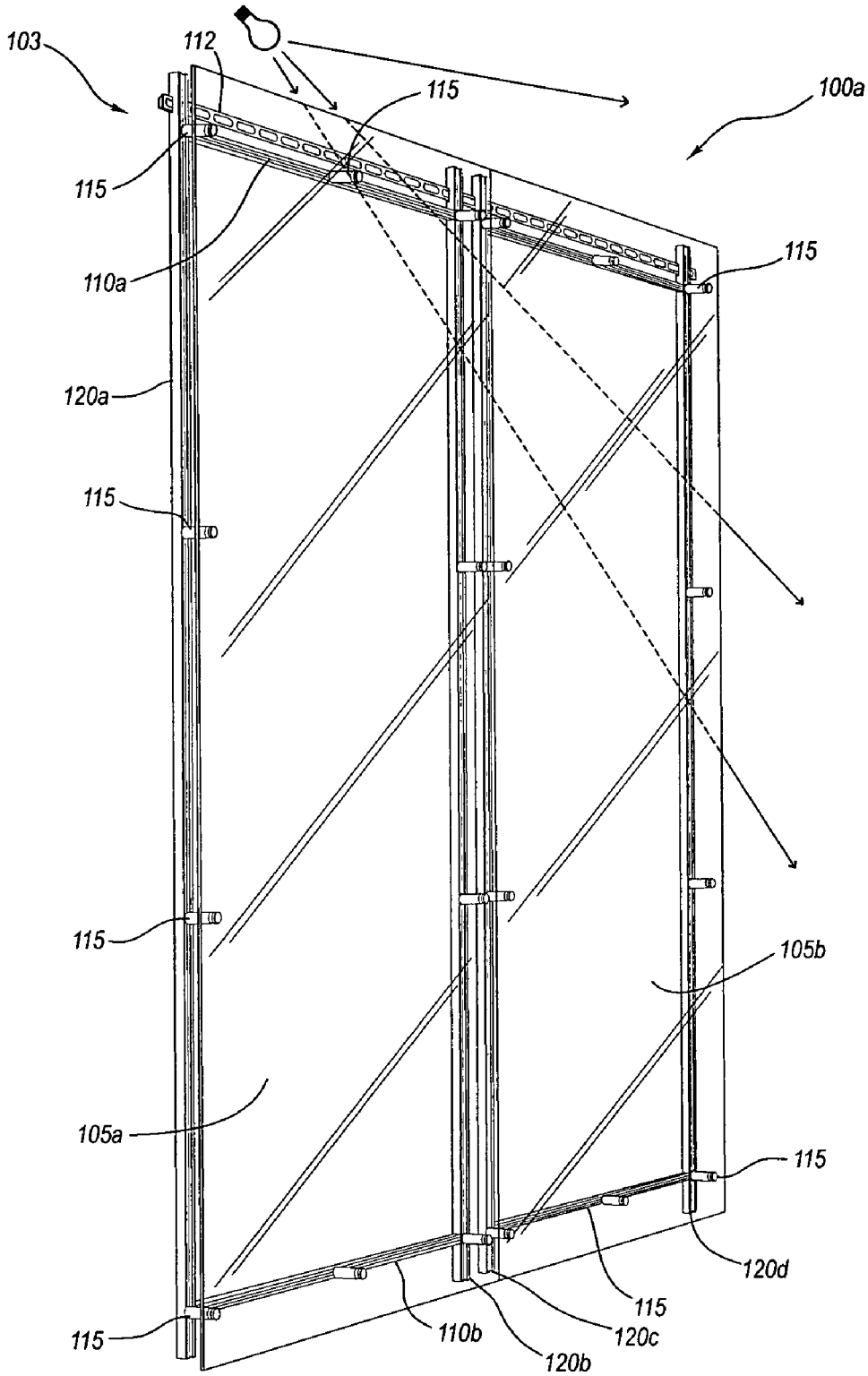
FIG. 1A illustrates a resin-based wall panel mounted to an existing wall at a standoff position in accordance with an implementation of the present invention.

For example, FIG. 1A illustrates a resin wall that has been mounted to a frame, and that can further be mounted to an existing wall. As shown, the resin wall 100*a* includes resin-based panels 105*a-b* that are mounted at a standoff position with respect to the frame 103 in accordance with an implementation of the present invention. Due to the resin wall's translucent properties, light can be transmitted from the frame 103 side of the resin wall 100*a* to an opposing side, since the resin wall 100*a* is translucent. The composition of the resin wall 100*a*, as well as resin walls 100*b* and 100*c* (as in the subsequent Figures), can be any suitable polymeric resin for creating a sufficiently solid vertical panel.

Examples of suitable polymeric resins include any copolyesters such as PET, PETG, PCTG, and the like; any acrylics such as PMMA; any polycarbonate material; and any combinations thereof. Panels made from these polymeric resins can be of varying color, translucence, and texture, and can also be made to include decorative objects. Panels made from these polymeric resins can also be made to have fire-resistance properties without sacrificing translucence, and so can be helpful when used in building applications, such as interior finishes, that carry additional flammability performance requirements as regulated by local or national building codes (e.g., flame spread and smoke tests characterized American Society for Testing and Materials E84—"ASTM E84").

Examples of adding color or decorative objects to a resin-based panel are found in commonly-assigned U.S. patent application Ser. No. 10/465,465, filed on Jun. 18, 2003, entitled "Laminate Structure with Polycarbonate Sheets and Method Of Making," which is a continuation-in-part of commonly-assigned U.S. patent application Ser. No. 10/086,269, filed on Mar. 1, 2002, entitled "Laminated Article and Method of Making Same," which claims the benefit of priority to U.S. Provisional application Ser. No. 60/273,076, filed on Mar. 5, 2001, entitled "Lamination of Dissimilar Materials and Method for Making Same." Examples of forming a polymeric resin-based panel with decorative objects are found in commonly-assigned U.S. patent application Ser. No. 10/821,307, filed on Apr. 9, 2004, entitled "Architectural Laminate Panel with Embedded Compressible Objects and Methods for Making the Same."

In addition, examples of adding fire-resistant properties to translucent polymeric resin-based materials, which are suited for use in interior finish applications, are found in commonly-assigned U.S. patent application Ser. No. 11/103,829, filed on Apr. 12, 2005, entitled "Fire-Resistant Architectural Resin-based materials," which claims the benefit of priority to U.S. Provisional Patent Application No. 60/579,004, filed on Jun. 11, 2004, entitled "Fire-Resistant Architectural Resin-based materials." The entire content of each of the aforementioned U.S. patent applications is incorporated by reference herein.

Referring again to the figures, frame 103 is configured to be easily assembled into a cross section that can be adjusted to the size and width of virtually any existing wall. For example, the frame 103 includes two or more horizontal frame members, such as horizontal frame members 110*a* and 110*b*, and two or more vertical frame members, such as vertical frame members 120*a-b*. The horizontal and vertical frame members in turn can be expanded or shortened, and reduced or multiplied in number as appropriate. Furthermore, the frame members 110 and 120 comprise multiple grooves, oz perforations, and/or tracks for adjustably receiving one or more mounting components or fasteners, such that the frame 103 can be adjusted and mounted to virtually any size or shape of existing wall.

Figure 1B:
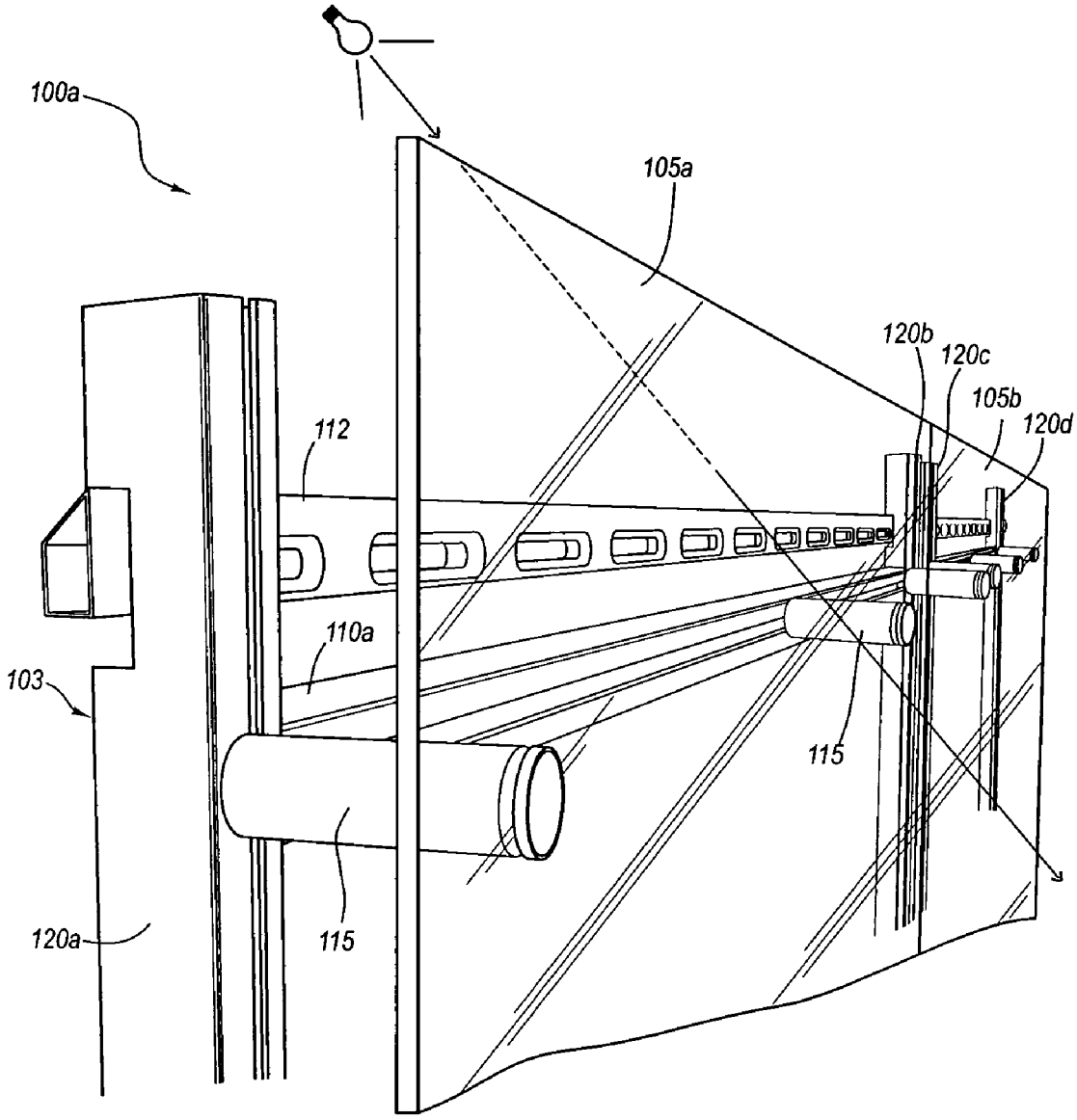
FIG. 1B illustrates a close up perspective view of at least one standoff assembly used to mount the resin-based wall panel illustrated in FIG. 1A.

As shown in the close up perspective view of FIG. 1B, the frame 103 can also be configured to receive any other support members, such as support member 112. For example, support member 112 is inserted in corresponding "Z-grooves" of the frame 103 on the side ultimately proximate to an existing wall, and can be used to stabilize the frame 103 in any of an X or Y orientation. In one implementation, the support member 112 is mounted inside an existing wall; while in other implementations, the support member 112 is mounted directly to an existing wall, and the vertical members 120 (e.g., 120*a-d*) mounted to the support member 112 essentially hang from the support member 112. The hanging effect of the support member 112 can be helpful for providing side-to-side adjustability of the overall frame 103.

The one or more support members 112 can be anchored to the frame 103 against the existing wall using any number of fasteners or anchor apparatus (not shown). As such, the one or more support members 112 also comprise any suitable grooves, perforations, and/or tracks, which can be used to help mount the frame to the existing wall (not shown). The horizontal members 110, vertical members 120, and/or support structure(s) 112 can be made of any suitably strong metal, alloy, polymeric material, and/or combinations thereof. (In one implementation, the frame members are selected for their aesthetic properties since they will be seen through the translucent resin-based materials.)

The grooves, perforations, and/or tracks of horizontal frame members 110*a-b* and vertical frame members 120*a-c* can also be configured to receive one or more securing members, such as standoffs 115, at one or more X/Y positions. As shown, standoffs 115 are configured in turn to receive a corresponding resin-based panel 105*a* on one end, and secure the given panel (e.g., 105*a-b*) at an extended position relative to the frame 103.

Figure 1C:
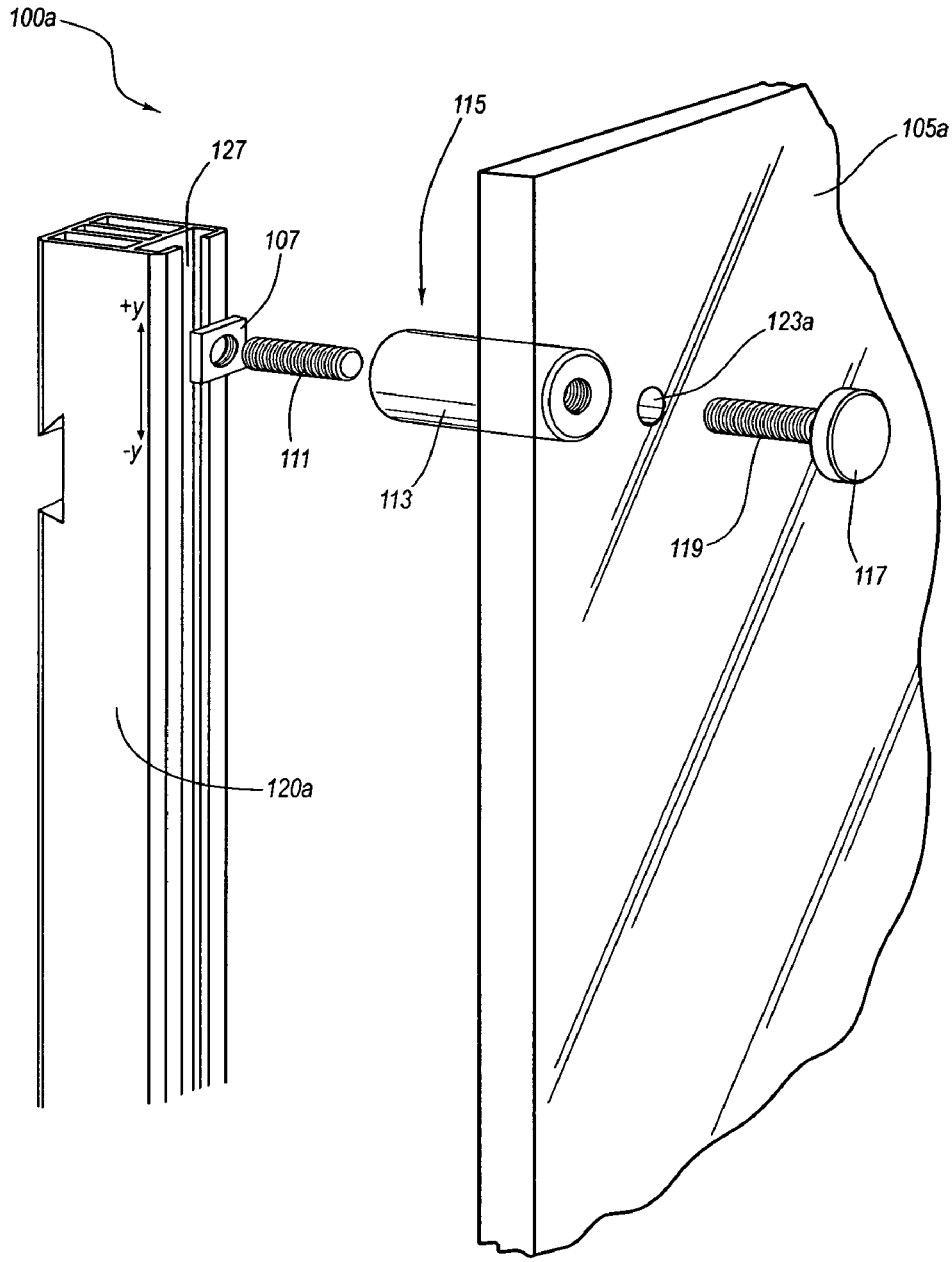
FIG. 1C illustrates an exploded perspective view of the standoff assembly illustrated in FIG. 1B when used to mount a top portion of the resin-based wall panel.

FIG. 1C illustrates a close up exploded perspective view of a standoff assembly 115 positioned between a resin-based panel 105*a* and a vertical member. In particular, FIG. 1C shows that standoff 115 comprises a body 113 configured with a threaded recess for receiving a threaded stem 119 that extends from a cap 117. The standoff body 113 in turn receives a threaded connector 111, which secures the standoff body 113 to the resin-based panel (e.g., 105*a*) on one side. The standoff body 113 also attaches to a slidable brace 107 on an opposing side. The brace 107 is further configured to slide within a groove 127 of the vertical member 120*a*. Thus, the body 113, connector 111, and brace 107 can slide in concert along groove 127 until the body 113 is tightened to a certain point with respect to the brace 107 and member 120*a*. The standoff 115, including cap 117, threaded member 119, body 113, connector 111 and brace 107 can be made of any appropriate metal, alloy, or polymeric materials, or combinations thereof, for holding a weight of a resin-based panel by itself, and/or with one or more other standoffs 115.

As also shown, the cap 117 secures the resin-based panel 105*a* to the standoff by inserting the threaded member 119 through a specifically sized eyelet 123*a*. In particular, FIG. 1C shows that threaded member 119 is inserted through eyelet 123*a* before being inserted and screwed into body 113. As shown, the eyelet 123*a* is about the same size (or slightly larger) in diameter as the threaded member 119, since what is shown is the upper portion of the panel 105*a*. This relatively precise size or diameter of eyelet 123*a* ensures that the resin-based panel 105*a* is secured where the relevant standoff body 113 is secured to the frame 103, and thus allows for little variation or modifiability of the same. In general, however, a manufacturer may desire to implement greater variability in this or other eyelets of the relevant panel.

Figure 1D:
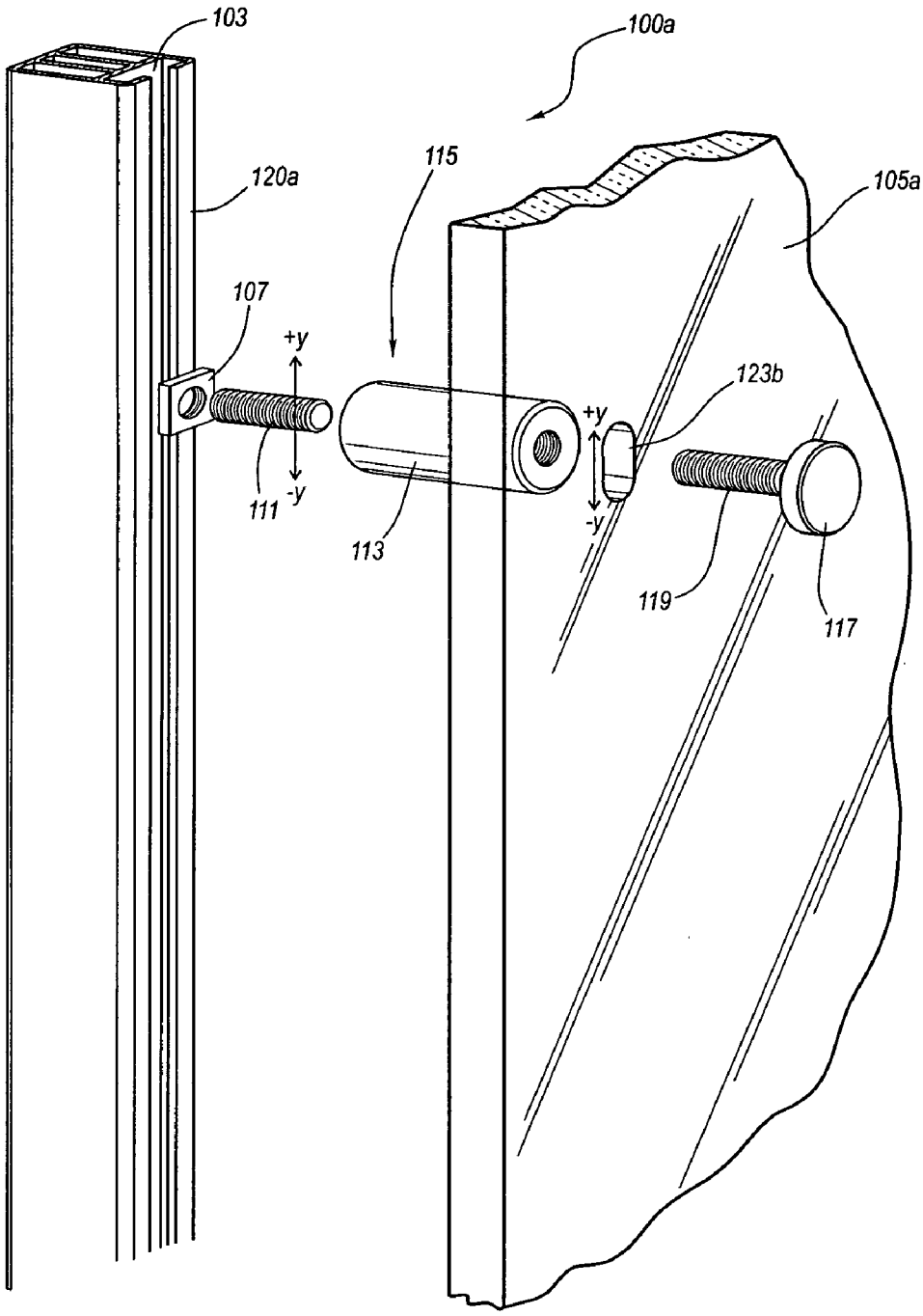
FIG. 1D illustrates an exploded perspective view of the standoff assembly illustrated in FIG. 1B when used to mount a lower portion of the resin-based wall panel.

For example, FIG. 1D shows a wider eyelet 123*b* that has been implemented in the lower portion of the panel 105*a*. In particular, FIG. 1D shows that the wider eyelet 123*b* provides at least a greater ±Y variability for positioning the panel 105*a* with respect to the standoff 115 (and hence to the relevant vertical or horizontal frame member). This variability in the lower eyelets (e.g., 123*b*) can help the resin-based panel 105*a* maintain appearances in spite of any natural degradation that might be associated with age. In particular, this type of ±Y variability in the lower portion can be helpful for resin-based panels made of materials that may be prone to some material redistribution. In one implementation, for example, these larger, oversized eyelets 123*b* are configured to account for expansion/contraction, while, in conjunction with standoff 113 (i.e., due to the ability to adjust the position of the standoff point support by sliding it up and down in the given vertical frame member) are duly configured to accommodate material creep. Accordingly, a manufacturer may find a wide variety of advantages by creating differently sized eyelets for different portions of each of the resin-based panels, as desired. That is, exact or differently sized eyelets 123*a-b* can provide flexibility to the assembler as well as durability in aesthetic appearance.

FIGS. 1A through 1D therefore show how the frame 103 and corresponding parts can be configured so that thread receptors can be readily positioned and matched with corresponding eyelets of the primarily flat, translucent resin-based panels. By contrast, FIG. 2A illustrates another implementation of a resin wall, or resin wall 100*b* in accordance with the present invention where one or more resin-based panels 130*a*, 130*b*, and 130*c* are configured to provide alternating, curved aesthetic effects.

Figure 2A:
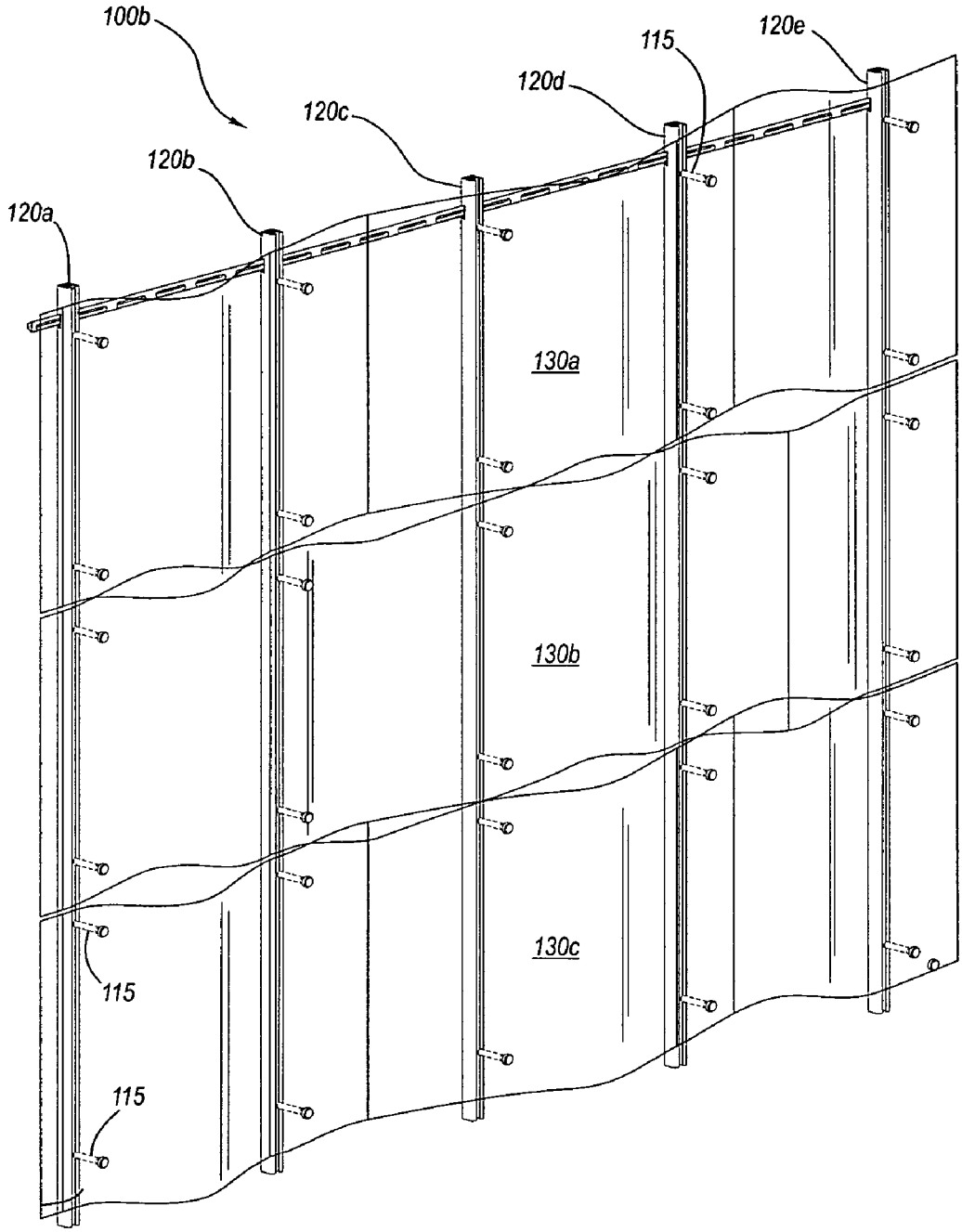
FIG. 2A illustrates another implementation of a resin-based wall panel in accordance with the present invention in which one or more resin-based wall panels are modified for a curved effect.

For example, FIG. 2A shows a facing perspective view of resin wall 100*b*, in which horizontally lain, vertically stacked panels 130*a-c* are formed with alternating and opposing curvatures. In particular, from left to right, panel 130*a* is convex (extending away from frame 103) between members 120*a* to 120*b*, and concave (extending toward frame 103) between vertical members 120*b* and 120*c*. By contrast, panel 130*b* is concave between vertical members 120*a* to 120*b*, but convex between vertical members 120*b* to 120*c*, and so forth. Panel 130*c*, in turn has a similar convex/concave pattern as panel 130*a*, or is another sequence of curvatures, as desired.

Figure 2B:
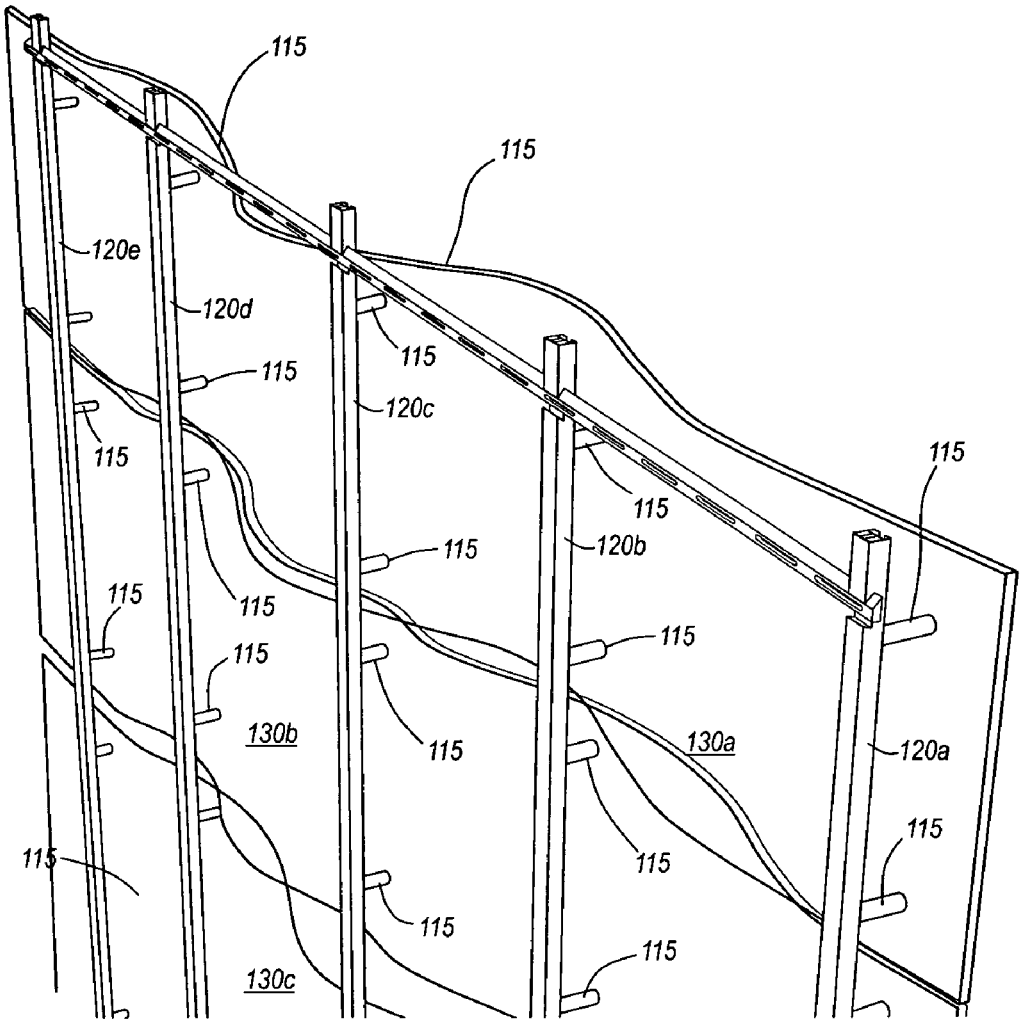
FIG. 2B illustrates a back perspective view of the resin-based wall panel illustrated in FIG. 2A.

FIG. 2B shows a back perspective view of the resin wall 100*b*. As shown each standoff 115 is substantially the same length between a given frame member (e.g., 120*a-e*) and the resin-based panel 130*a-c*, and hence provides the same length of distance between the relevant resin-based material and the existing wall at the given attachment point (e.g., 117 attached at an eyelet 123, FIG. 2C). One will appreciate, however, that the length of the given standoff 115 can be varied by a manufacturer to enhance this curved effect as desired, or to create other types of shapes using curvature. For example, in one implementation, the manufacturer implements progressively longer standoffs (not shown) from vertical member 120*a* through 120*e*, thereby creating a waved effect that progressively extends toward the viewer. In sum, there are a wide variety of ways in which a manufacturer can create and/or enhance a curved aesthetic effect.

Figure 2C:
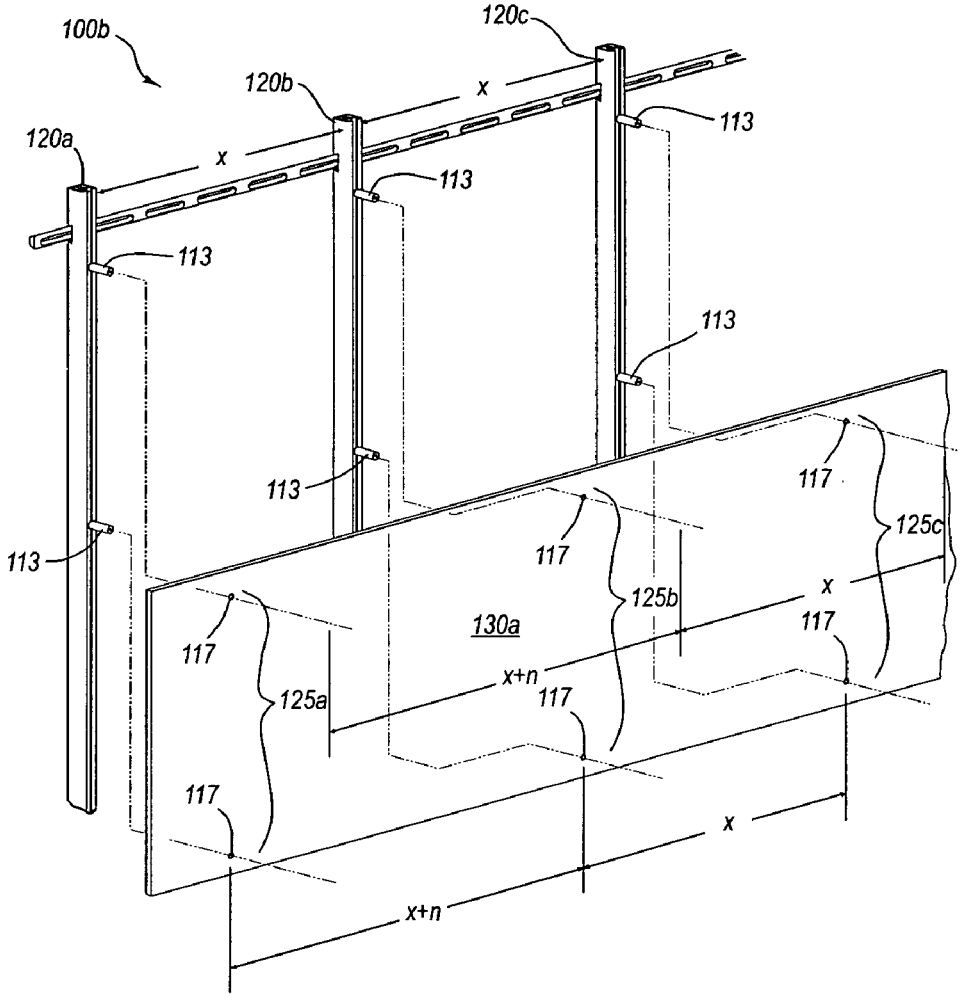
FIG. 2C illustrates a facing diagrammatic view of a panel and a frame configured to create the wave effect illustrated in FIG. 2A.

In any event, in order to create the curved effect in the first instance, FIG. 2C illustrates one way in which this can be accomplished. In particular, FIG. 2C shows each of the vertical members 120*a*, 120*b*, and 120*c* of an eventual frame 103 are separated an equal distance of "x" from the next vertical member. By contrast, an exemplary panel 130 has a first position of eyelets 125*a* and a second set eyelets 125*b* that are separated a distance of "x+n" (i.e., where "n" is greater than 0). Panel 130 further has a third set eyelets 125*c*, which are positioned a distance "x" from the second position of eyelets 125*b*.

The first position of eyelets 125*a* are configured to receive a threaded member 119, which fastens into a corresponding standoff bodies 113 that has been previously secured to vertical member 120*a*. The second position of eyelets 125*b* are similarly configured to receive a threaded member 119 that will also be fastened into the standoff bodies 113, albeit one positioned in vertical member 120*b*. Similarly, the third position of eyelets 125*c* are configured to align with the standoff bodies 113 positioned in vertical member 120*c*. Since there is a greater amount of distance (i.e., "x+n") in the between the first position of eyelets 125*a* and the second position of eyelets 125*b* than the spacing between vertical members 120*a* and 120*b*, the resin-based panel 2C will bow outwardly or inwardly as desired, based on the flexibility or thickness of the chosen material. For example, in one implementation, the manufacturer uses a thicker, lower-modulus resin-based material that is subject to bending. In another implementation, the manufacturer uses a more rigid material that is made flexible due to its relative thickness (e.g., quarter inch or thinner).

By contrast, where the distance "x" between the second position of eyelets 125*b* and third position of eyelets 125*c* of caps 117 is equal to the spacing between vertical members 120*b* and 120*c*, the resin-based panel 130 will simply be held in a flat conformation. This spacing, therefore, is merely exemplary, and contrasts with FIGS. 2A and 2B, which show either concave or convex bowing between vertical members 120*a-e*. Accordingly, FIGS. 2A through 2C show that a manufacturer can adjust the spacing or positioning of eyelets in a given polymeric resin-based panel to achieve a wide range of aesthetic effects, such as that provides each given panel with a desired shape or lay with respect to the frame 103.

Figure 3A:
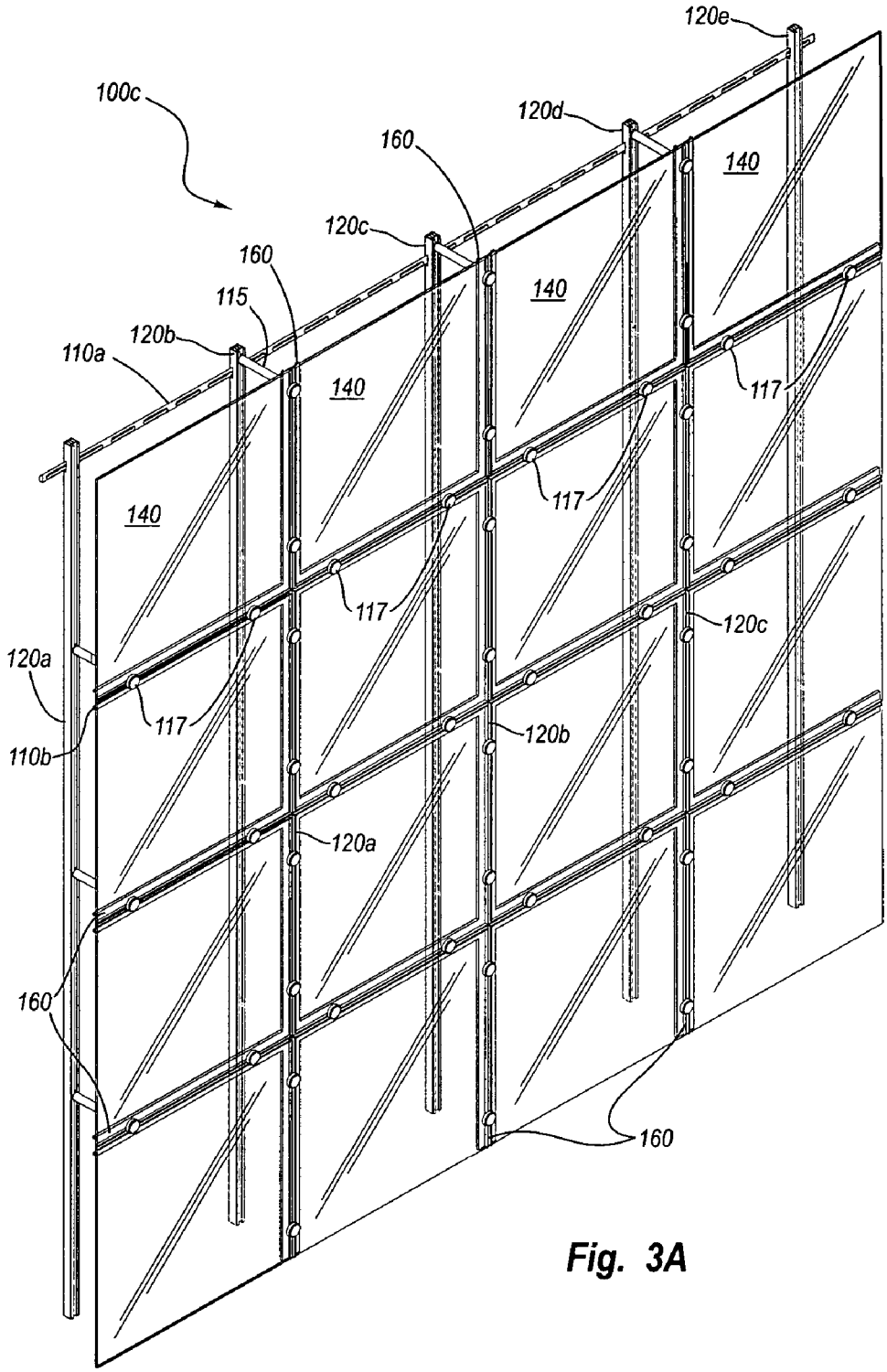
FIG. 3A illustrates still another implementation of a resin-based wall panel in accordance with the present invention in which one or more resin-based wall panels are mounted within a grid system.

FIG. 3A illustrates still another implementation of a resin wall, or resin wall 100*c*, in accordance with the present invention, wherein one or more resin-based panels 140 are mounted to a frame assembly in a grid-like fashion. In contrast with the preceding Figures, however, none of the panels 140 include eyelets through which a threaded member 119 of a cap 117 is inserted to join with a standoff body 113. Rather, as further shown in FIG. 3B, resin wall 100*c* comprises two frames, such as frame 103 and secondary frame 160, set apart by standoffs 115. The resin-based panels 140 are then held in place by overlapping caps 117, which overlap and secure the peripheral edges of each panel 140. For example, in FIG. 3B, secondary frame 160 is held at an extended position from frame 103 via standoffs 115, while each of resin-based panels 140 are held in place by overlapping caps 117.

Figure 3B:
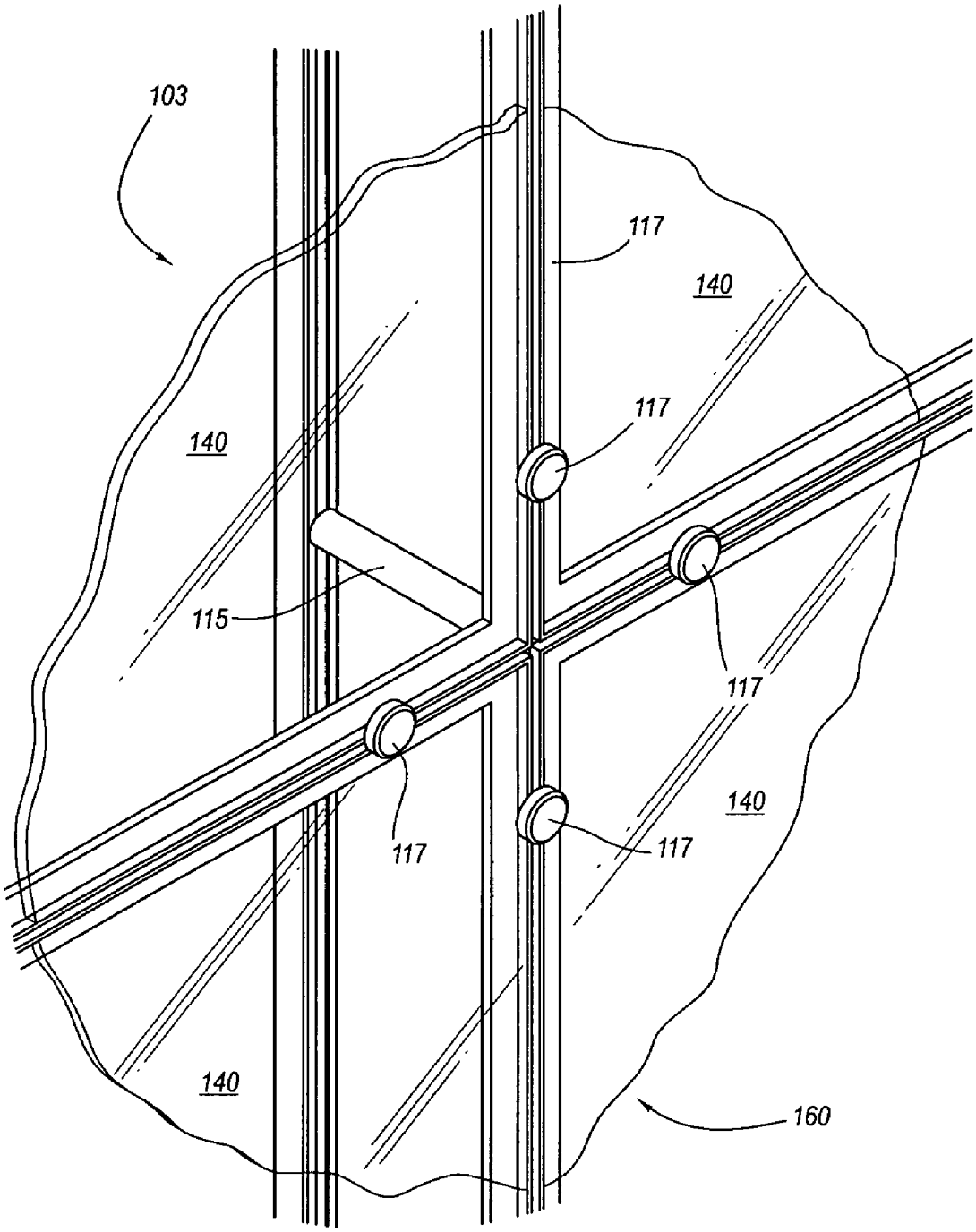
FIG. 3B illustrates a close up perspective view of a grid intersection of the resin-based wall panel illustrated in FIG. 3A.
Figure 3C:
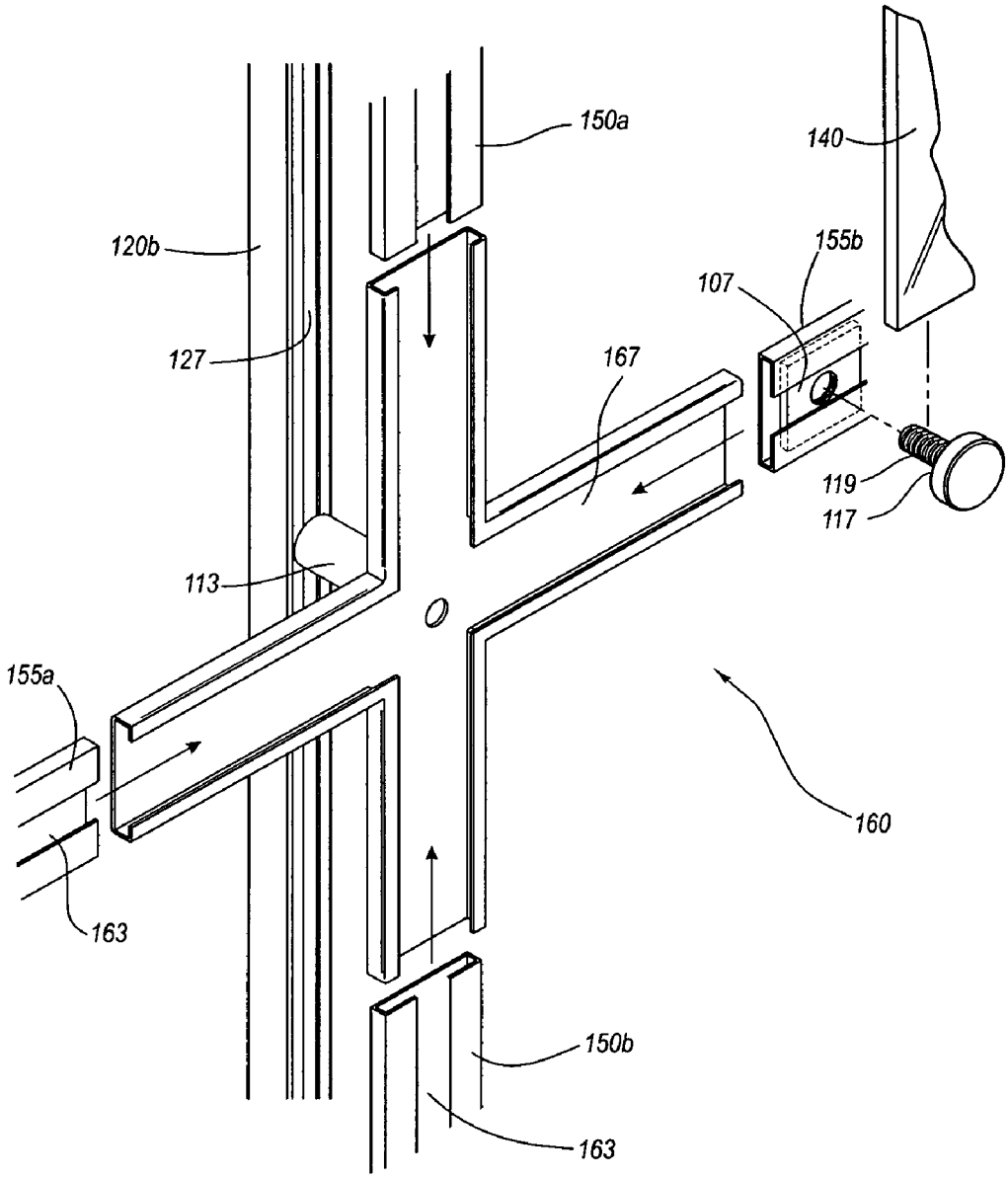
FIG. 3C illustrates an exploded perspective view of an intersection assembly of the frame used in creating the grid intersection illustrated in FIG. 3B.

FIG. 3C illustrates an exploded perspective view of one implementation of the grid intersection illustrated in FIG. 3B. In particular, a grid intersection of secondary frame 160 can be created using a mitered intersection connector 167, which includes vertical arms for receiving vertical members 150*a* and 150*b*, as well as perpendicular, horizontal arms for receiving horizontal members 155*a* and 155*b*. Each of horizontal members 155*a-b* and vertical members 150*a-b* include a groove 163, through which an assembler inserts brace 107. The vertical members 150*a* and 150*b*, and horizontal members 155*a-b* may be the same vertical members as any of 120*a-c* and/or the same as any of horizontal members 110*a-c* shown previously, or may be different vertical or horizontal members, or some other modified portions thereof.

In one method of assembly, an assembler mounts the various horizontal frame members 110 (e.g., 110*a-c*) and vertical frame members 120 (e.g., 120*a-d*) with any necessary support members 112 against an existing wall (not shown). The assembler then creates the secondary frame 160 by inserting each of the horizontal frame members 155*a-b* and vertical frame members 150*a-b* (or portions of members 110 and/or 120) into an intersection connector 167. The assembler also secures a standoff body 113 to a position of a vertical frame member (e.g., 120*b*), and inserts any appropriate braces 107 within grooves 163 of the vertical frame members 150*a-b* and horizontal frame members 155*a-b* of the secondary frame 160. The intersection connector 167 is then secured to the standoff body 113, and the assembler then aligns each panel 140 in the appropriate grid position. The assembler then secures each panel 140 by screwing any appropriate number of caps 117 into the braces 107 of the secondary frame 160. When all panels 140 and frames 103 (or also 160) are assembled together, the resulting structure resembles the structure shown in FIGS. 3A and 3B.

Figure 4A:
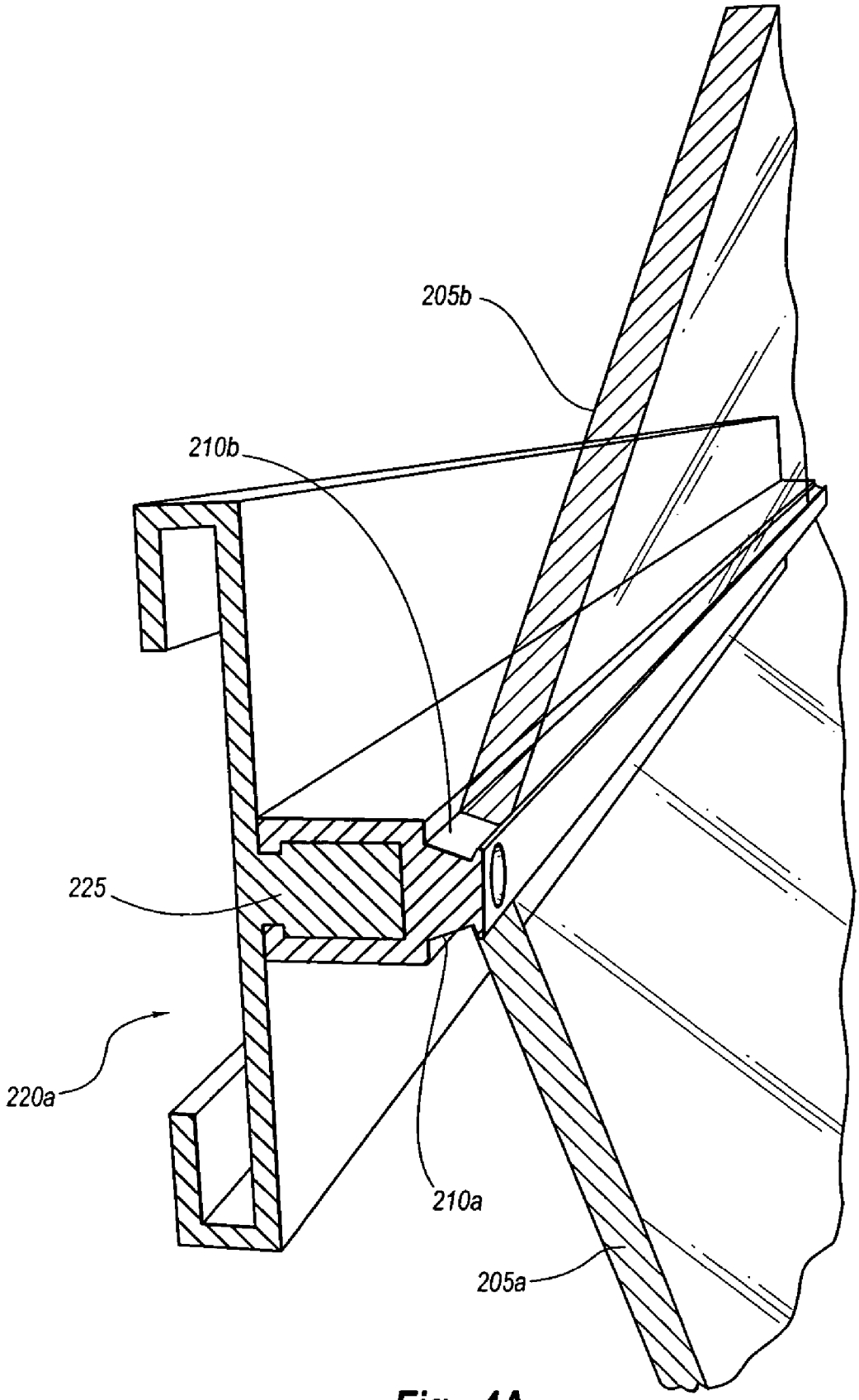
FIG. 4A illustrates a top perspective view of another implementation of a resin-based wall panel system, wherein one or more resin-based wall panels are positioned between ridged frame members to create a curved effect.

FIG. 4A illustrates a top perspective view of another implementation of a resin wall system, wherein one or more resin-based panels are positioned between ridged frame members to create a curved effect. In particular, a resin-based panel 205*a* can be placed inside another form of a securing member, or elongate groove 210*a*, which is mounted on one frame member 220*a*, and inside another securing member, or elongate groove (not shown), of a next/adjacent frame member (not shown). For example, FIG. 4A shows that panel 205*b* is placed in the opposite elongate groove 210*b* of the frame member 220*a*. If the frame members (e.g., 220*a*, and other frame members not shown) are placed sufficiently close together, the resin-based panel will bow in one of a concave or convex direction, as desired. Alternatively, the manufacturer or assembly might opt to straighten the panels by separating the relevant frame members 220.

Figure 4B:
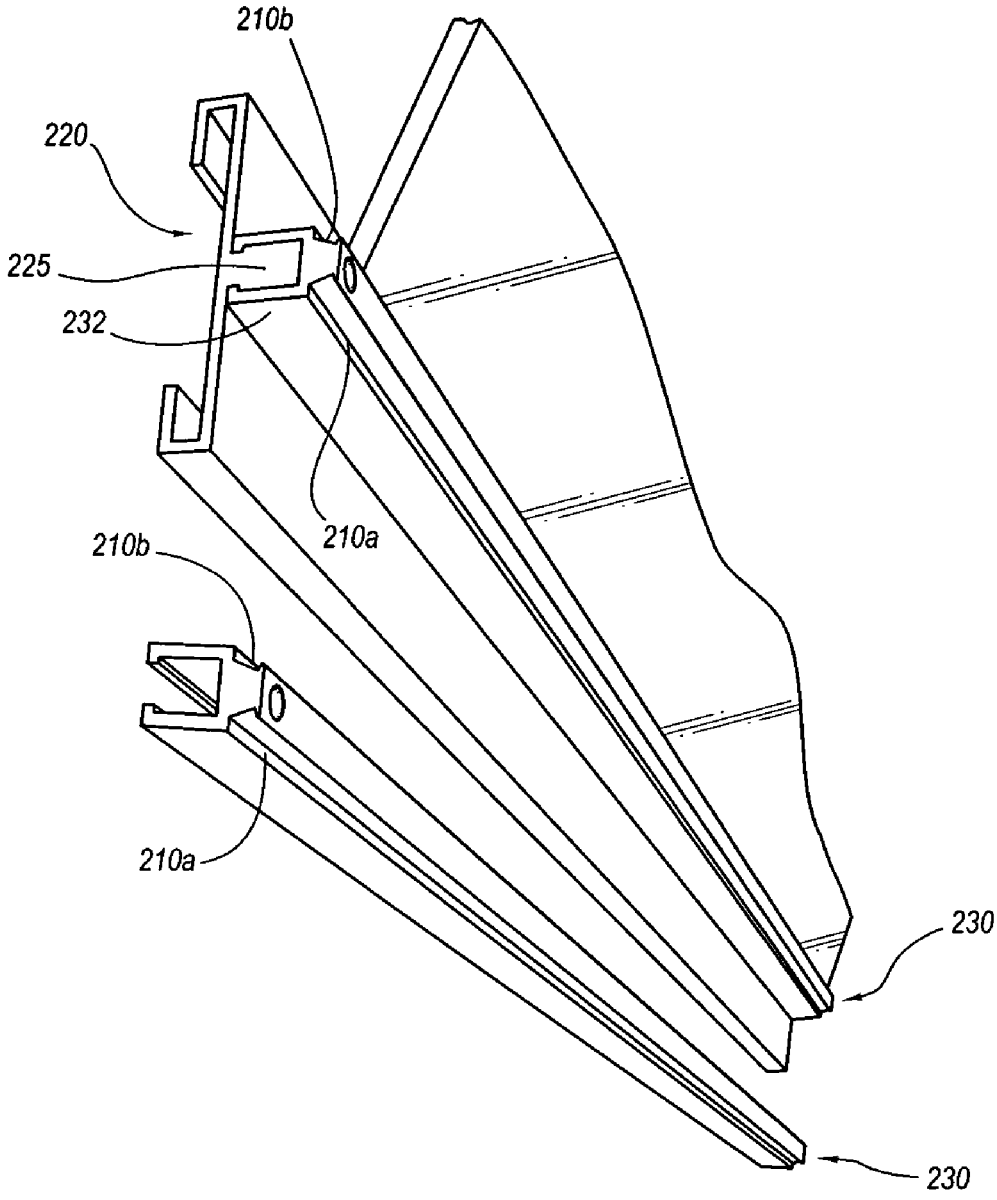
FIG. 4B illustrates an exploded view of resin-based wall panels and frame members of the resin-based wall system shown in FIG. 4A.

FIG. 4B illustrates a dissembled view of resin-based panels and frame members of the resin wall system shown in FIG. 4A. In particular, FIG. 4B shows that a frame member 220*a* comprises an elongate attachment 230, which is inserted over a protruding neck portion 225. The elongate attachment 230 comprises corresponding elongate grooves 210*a-b* (or securing members) formed on opposing sides. There are, of course, other ways of providing grooves into which a resin-based panel can be inserted, and ultimately made to curve. For example, the elongate groove 210*a-b* can be formed directly in the frame member itself, rather than in a separate attachment. Alternatively, the grooves 210*a-b* may be less elongate, and more sporadically spaced, or may be evident as a combination of multiple clips providing similar function. As such, one will appreciate that the apparatus and systems shown in FIG. 4B are merely exemplary.

Accordingly, the present invention provides a wide variety of systems and apparatus for mounting translucent resin walls to existing walls, and for adding a decorative, aesthetically pleasing appearance to existing walls. Furthermore, implementations of the present invention allow for existing walls to take on a pleasing appearance without significant hassle, at least in part since the frame systems can be easily modified to accommodate virtually any existing wall. Still further, implementations of the present invention provide for one or more frames that can be easily assembled with pre-cut, pre-drilled components that are configured for any number of conformations or designs, and that are configured to hold their designs in a pleasing manner even after some natural changes occur to the resin-based materials. Thus, implementations of the present invention provide a number of important advantages over conventional glass or resin wall systems.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A translucent wall assembly comprising:

a support member mountable to a generally flat, continuous interior wall;

a frame having a plurality of vertical members, at least some of which have a vertical track, and a plurality of horizontal members, at least some of which have a horizontal track, the vertical members being hung from the support member so as provide side-to-side adjustability of the frame, and side-to-side adjustability of the distance between each vertical member as desired, and the vertical members of the frame also serving to vertically position the frame adjacent the wall so that the frame is spaced by an essentially uniform distance from the wall and in an essentially parallel fashion;

a plurality of standoffs connected to the frame, at least some of the standoffs being slidably mounted to one or more of the vertical tracks of vertical support members of the frame, and at least some other standoffs being slidably mounted to one or more horizontal tracks of horizontal members of the frame; and a plurality of resin-based panels connected to the frame by the plurality of standoffs, the standoffs serving to space the mounted panels from the interior wall such that light is able to pass through the mounted panels to create a translucent effect, and wherein each resin-based panel is a substantially flat panel that extends from a floor end of the frame to a top end of the frame so as to create a translucent wall standing generally parallel and next to the interior wall when assembled.

2. The translucent wall assembly as recited in claim 1, wherein the resin-based panel is fire resistant.

3. The translucent wall assembly as recited in claim 1, wherein the resin-based panel comprises one or more decorative elements including any one or more of a colored image layer, a texture layer, and one or more decorative objects embedded inside.

4. The translucent wall assembly as recited in claim 1, wherein the distance between vertical members of the frame is uniform and wherein at least some of the resin-based panels are secured to the vertical members in a manner so that the at least some resin panels will be caused to bows in a convex or concave formation.

5. The translucent wall assembly as recited in claim 1, wherein the at least some resin-based panels comprise a first set of eyelets and a second set of eyelets for connecting the at least some resin-based panels to the vertical members.

6. The translucent wall assembly as recited in claim 5, wherein the first and second sets of eyelets are alternately spaced by a first distance and a second distance, with the second distance being greater than the first distance, such that the at least some resin-based panels bow inward or outward when connected to the vertical members.

7. The translucent wall assembly as recited in claim 1, wherein the resin-based panels are each substantially flat, extending from a first horizontal member to a second horizontal member, and extending from a first vertical member to a second vertical member.

8. The translucent wall assembly as recited in claim 7, wherein the frame is separated from a secondary frame by a body portion of a plurality of standoffs.

9. The translucent wall assembly as recited in claim 8, further comprising a plurality of caps which secure the plurality of resin-based panels to the frame by overlapping edges of adjacent panels.

10. A translucent wall assembly comprising:

a support member mountable to a generally flat, continuous interior wall;

a frame having a plurality of vertical members, at least some of which have a vertical track, and a plurality of horizontal members, at least some of which have a horizontal track, the vertical members being hung from the support member so as provide side-to-side adjustability of the frame, and side-to-side adjustability of the distance between each vertical member as desired, and the vertical members of the frame also serving to vertically position the frame adjacent the wall so that the frame is spaced by an essentially uniform distance from the wall and in an essentially parallel fashion;

a plurality of standoffs connected to the frame, at least some of the standoffs being slidably mounted to one or more of the vertical tracks of vertical support members of the frame, and at least some other standoffs being slidably mounted to one or more horizontal tracks of horizontal members of the frame;

a plurality of resin-based panels connected to the frame by the plurality of standoffs, the standoffs serving to space the mounted panels from the interior wall such that light is able to pass through the mounted panels to create a translucent effect, and wherein each resin-based panel is a substantially flat panel that extends from a floor end of the frame to a top end of the frame so as to create a translucent wall standing generally parallel and next to the interior wall when assembled; and first, second and third sets of eyelets formed in the plurality of resin-based panels intermediate opposing vertical ends thereof, the first and second sets of eyelets being spaced from one another by a first distance and the second and third sets of eyelets being spaced from one another by a second distance, and wherein the first distance is less than the second distance, such that each flexible resin-based panel is forced to bow inwardly or outwardly along a plane when connected to the vertical members at the positions defined by said first, second and third sets of eyelets.

* * * * *

UNITED STATES PATENT AND TRADEMARK OFFICE

CERTIFICATE OF CORRECTION

PATENT NO. : 8,046,967 B2
APPLICATION NO. : 11/402720
DATED : November 1, 2011
INVENTOR(S) : Suare et al.

It is certified that error appears in the above-identified patent and that said Letters Patent is hereby corrected as shown below:

Column 5
Line 8, change "providing an existing walls" to --providing existing walls--

Column 7
Line 32, change "113" to --113,--

Column 9
Line 56, change "220a" to --220--

Signed and Sealed this
Thirty-first Day of January, 2012

David J. Kappos

David J. Kappos
*Director of the United States Patent and Trademark Office*